US006422319B2

(12) United States Patent
Haase, III

(10) Patent No.: US 6,422,319 B2
(45) **Date of Patent: *Jul. 23, 2002**

(54) WATER DISTRIBUTION NETWORK FOR DOMESTIC WATER AND FIRE PROTECTION APPLICATION

(76) Inventor: Franz P. Haase, III, 184 Elm Hill, Peterborough, NH (US) 03458

( * ) Notice: Subject to any disclaimer, the term of this patent is extended or adjusted under 35 U.S.C. 154(b) by 0 days.

This patent is subject to a terminal disclaimer.

(21) Appl. No.: 09/858,243

(22) Filed: May 15, 2001

Related U.S. Application Data

(63) Continuation-in-part of application No. 09/502,185, filed on Feb. 10, 2000, now Pat. No. 6,241,024, which is a continuation-in-part of application No. 09/094,713, filed on Jun. 15, 1998, now Pat. No. 6,044,911, which is a continuation-in-part of application No. 08/904,355, filed on Aug. 1, 1997, now abandoned, which is a continuation of application No. 08/709,121, filed on Sep. 6, 1996, now abandoned.

(51) Int. Cl.[7] ..... A62C 35/00

(52) U.S. Cl. ..... 169/16; 169/5; 239/208; 137/357

(58) Field of Search ..... 169/5, 13, 16, 169/17, 18, 54; 239/208, 209, 536, 565; 137/357

(56) References Cited

U.S. PATENT DOCUMENTS

| | | | | | |
|---|---|---|---|---|---|
| 166,003 | A | * | 7/1875 | Harris | 239/562 |
| 2,017,841 | A | * | 10/1935 | Coleman | 169/16 |
| 2,353,117 | A | * | 7/1944 | Rider | 169/9 |
| 3,833,062 | A | * | 9/1974 | Livingston | 169/16 |
| 3,892,277 | A | * | 7/1975 | Curran | 169/16 |
| 3,993,139 | A | * | 11/1976 | Vaughn | 239/209 |
| 4,791,993 | A | * | 12/1988 | Curran | 169/16 |
| 4,930,579 | A | * | 6/1990 | George | 169/54 |
| 5,165,482 | A | * | 11/1992 | Smagac et al. | 169/13 |
| 5,183,102 | A | * | 2/1993 | Clark | 169/16 |
| 5,201,554 | A | * | 4/1993 | Gagg et al. | 285/276 |
| 5,236,002 | A | * | 8/1993 | Martin et al. | 137/508 |
| 5,239,794 | A | * | 8/1993 | Klein | 52/169.6 |
| 5,327,976 | A | * | 7/1994 | Hattori | 169/16 |
| 5,396,959 | A | * | 3/1995 | Macdonald | 169/16 |
| 5,413,134 | A | * | 5/1995 | Burgess et al. | 137/357 |
| 5,720,659 | A | * | 2/1998 | Wicks | 454/256 |
| 5,799,735 | A | * | 9/1998 | Sundholm | 169/13 |
| 6,044,911 | A | * | 4/2000 | Haase, III | 137/357 |
| 6,081,196 | A | * | 6/2000 | Young | 340/606 |
| 6,164,381 | A | * | 12/2000 | Sundholm | 169/13 |
| 6,241,024 | B1 | * | 6/2001 | Haase, III | 137/357 |

* cited by examiner

*Primary Examiner*—Steven J. Ganey
(74) *Attorney, Agent, or Firm*—Fulbright & Jaworski LLP

(57) ABSTRACT

An integrated water distribution network supplies the requirements of both domestic and fire protection water fixtures in a dwelling structure. The network includes a plurality of multiport fittings which are interconnected together with flexible conduits. A water release device, such as a sprinkler head or mist nozzle, is also coupled to the multiport fittings. The network is supplied water by a plurality of water supply lines which originate at a manifold. Individual water fixtures are connected to the distribution system through flexible lines. During use of a water fixture, water flow through at least a portion of the system is established. The distribution system can thus characterized as a "nonstagnant" water network for supplying both domestic and fire protection requirements of a structure.

24 Claims, 7 Drawing Sheets

WATER DISTRIBUTION NETWORK FOR DOMESTIC WATER AND FIRE PROTECTION APPLICATION

RELATED APPLICATIONS

This application is a continuation-in-part application of application Ser. No. 09/502,185 filed Feb. 10, 2000, now U.S. Pat. No. 6,241,024, which is a continuation-in-part application of application Ser. No. 09/094,713 filed Jun. 15, 1998, now U.S. Pat. No. 6,044,911 which was a continuation-in-part of application Ser. No. 08/904,355 filed Aug. 1, 1997, now abandoned, which was a continuation application of Ser. No. 08/709,121 filed Sep. 6, 1996, now abandoned.

BACKGROUND OF THE INVENTION

1. Field of the Invention

This invention generally relates to an integrated domestic water system and interior fire protection system. More particularly it relates to an integrated residential domestic water and fire protection system.

2. Description of the Prior Art

Dedicated sprinkler systems which are connected to large diameter water supply mains are known in the prior art. These water sprinkler systems may be characterized as "stagnant" water systems, in that the water flows within the system only when a sprinkler head is activated. Also well known in the art are residential domestic water distribution systems for supplying water to a variety of plumbing fixtures within a dwelling. For a variety of reasons (codes, regulations, etc.) domestic water systems can not be "stagnant," that is, water contained within the system must be capable of flowing under normal operating conditions. As a result of this requirement for "nonstagnant" flow systems, for typical building applications the fire sprinkler distribution system and the domestic water distribution system are two independent and separate systems. An obvious limitation having separate domestic water distribution network and fire sprinkler network is that each system must have their own conduits, supports, fittings, drains, valves, etc. This duplicity of system components is both uneconomical (additional materials, labor, etc.) and environmentally disadvantageous (additional water requirements). To a large extent, the expense caused by the duplicity of system components required by separate independent water distribution networks has limited the acceptance of fire sprinkler networks to commercial or multiuse residential applications. A further limitation of present fire sprinkler systems is that they require regular inspections of system operability as it is critical that water under pressure be supplied to the various sprinkler assemblies. Typically this requires that the occupant occasionally inspect and verify valves, gages, etc. for operability.

It would be desirable and advantageous to implement a fire sprinkler system which would be cost-effective so as to find acceptance in the residential building industry. It would also be desirable to have such a sprinkler system which would incorporate the domestic water distribution network into the fire sprinkler distribution network. At the same time, and most importantly, the combined system would be a "nonstagnant" system to meet the approval of industry. By incorporating or integrating the sprinkler network with the domestic water network according to the present invention, a water flow is established throughout generally the entire network each time a plumbing fixture is accessed. It would also be desirable that the combined system be "self-checking" to verify fire sprinkler system operability. As a result, the integrated water distribution system according to the present invention is a "nonstagnant" water flow system which can meet the requirements of various plumbing codes and regulations. The use of the plurality of multiport fitting each having a plurality of external nipples permits the use of small flexible conduit which facilitates assembly and installation.

Typical fire sprinkler heads release water in a stream or deluge of relatively large water droplets and in relatively large quantity. Excessive water release through the sprinkler heads, particularly after extinguishment of the fire, has lead to water damage of interior spaces and contents. Water mist technology has been recognized as an alternative to fire sprinkler water heads. Water mist technology utilizes small water droplets, at relatively small water volumes, to extinguish a fire. Water droplets, in the form of a mist or fog, absorb tremendous amounts of energy away from a heated surface during the transformation from liquid to a gas (steam). Water expansion into steam removes heat from the burning fuel so as to lower its temperature below the ignition threshold. Further, the droplets of water and steam impinge on the surface of the fire to create an oxygen-depleting blanket. The water mist or fog may be created by nozzles or heads.

SUMMARY OF THE INVENTION

The present invention is directed to an integrated water distribution system for supplying a building's domestic water needs and fire protection system requirements without the duplicity of having separate water distribution networks. Importantly, a nonstagnant water distribution system can provide water requirements for both domestic use and fire protection use. One aspect of the present invention provides a multiport fitting for overhead securement and for use with a heat sensitive sprinkler head for a fire sprinkler system. Another aspect of the present invention provides a "self-checking" fire sprinkler system with which the occupant can easily verify sprinkler operability by accessing a plumbing fixture for use, as pressurized water at any fixture within the network ensures pressurized water at all the fire sprinklers. Yet another aspect of the present invention provides a mounting assembly for securing the multiport fitting in its overhead position.

One embodiment of the integrated water distribution network includes a plurality of multiport fittings, each fitting being interconnected using flexible plastic conduit with at least one other fitting. Each fitting has a plurality of water conduits each leading to a plurality of exterior nipples upon which the flexible plastic conduit may be secured. Each water conduit, when connected as described herein allows fluid communication with integrated network. There is thus a nonstagnant sprinkler water distribution and domestic water distribution integrated network having sprinkler head positions and domestic water plumbing fixture positions as would be provided by a separate and independent sprinkler network and an independent domestic water distribution network.

Another embodiment of the present invention provides an integrated water distribution network for supplying both domestic water and fire sprinkler water requirements of a structure, the network including: (i) a plurality of water-carrying conduits defining a water-carrying loop; (ii) a plumbing fixture in fluid communication with the plurality of water-carrying conduits, said plumbing fixture requiring an amount of water during a use thereof; (iii) a plurality of water release devices disposed upon the structure and in fluid communication with the plurality of water-carrying conduits; and (iv) a water supply conduit in fluid communication with said plurality of water-carrying conduits for supplying the amount of water relating to the use of the plumbing fixture, wherein upon the use of the plumbing fixture, a water flow is established in substantially all of the plurality of water-carrying conduits. The water release devices may include a fire sprinkler device or assembly, a water mist nozzle or head assembly, and other water releasing devices which are triggered upon the occurrence of an event to release water. The trigger event for water release devices may include a thermally frangible or releasable device, such as a bronze alloy, etc. The trigger event may also be an electronic signal from a remote controller to release water upon occurrence of a fire event.

These and further objects of the present invention will become apparent to those skilled in the art with reference to the accompanying drawings and detailed description of preferred embodiments, wherein like numerals refer to like parts throughout.

A DETAILED DESCRIPTION OF PREFERRED EMBODIMENTS

Figure 1:
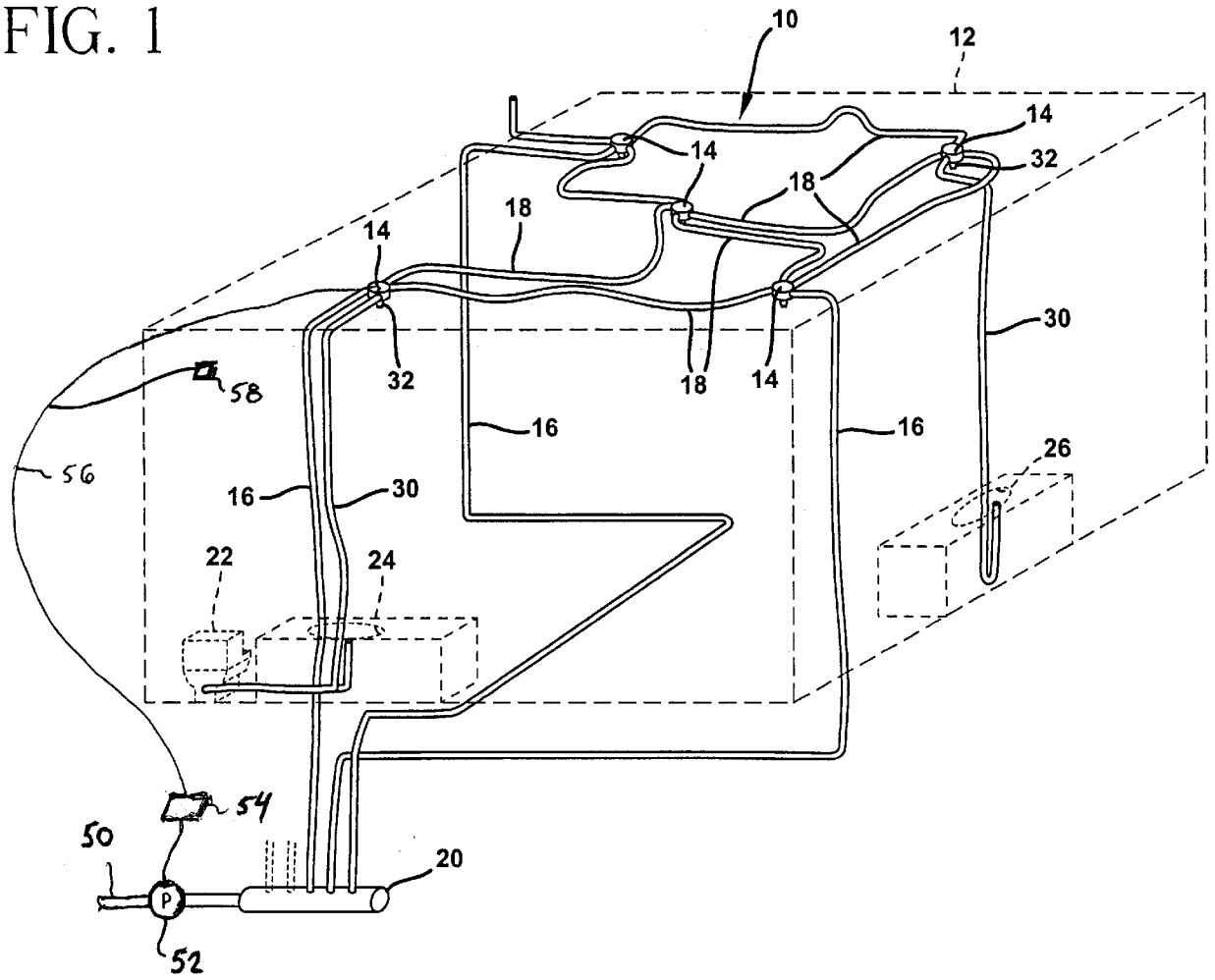
FIG. 1 is a perspective view of an integrated water distribution network according to the present invention.

An integrated water distribution system 10 for a building 12, such as a residential structure, is illustrated in FIGS. 1–4, and FIGS. 7–8. The system 10 includes a plurality of multiport fittings 14 interconnected with a plurality of flexible plastic conduit 16, 18. Referring particularly to the embodiment of FIGS. 1–8, the conduits includes risers or water supply lines 16 which emanate from a supply manifold 20 which is connected to the house main 50 and runners 18 which traverse between the various multiport fittings 14 and plumbing fixtures 22, 24, 26. Plumbing fixtures 22, 24, 26 are individually served by a routed flexible plastic conduit 30 and may include a watercloset 22, tub, vanity sink 24, or kitchen sink 26. A water release device 32, such as a fire sprinkler head or water mist nozzle, are coupled to each multiport fitting 14. Additional plumbing connections or attachments such as valves, piping, expansion tanks, pipe fittings (elbows, tees, etc.) are all well know in the art of plumbing. Likewise, unidirectional flow valves and temperature activated sprinkler heads are also well known in the art of sprinkler system design and installation. These additional components, which may be needed to fully implement a functional water distribution system according to the present invention, are well known to those skilled in the art and are not shown in the exemplary environment of FIGS. 1–4.

The water release device 32 may include a fire sprinkler head or a water mist nozzle/device. Typical fire sprinkler heads release water in a stream or deluge of relatively large water droplets and in relatively large quantity. Water mist technology utilizes small water droplets, at relatively small water volumes, to extinguish a fire. Water droplets, in the form of a mist or fog, absorb tremendous amounts of energy away from a heated surface or fire during the transformation from liquid to a gas (steam). Water expansion into steam removes heat from the burning fuel so as to lower its temperature below the ignition threshold. Further, the droplets of water and steam impinge on the surface of the fire to create an oxygen-depleting blanket. The water mist or fog may be created by nozzles or heads. The optimum water droplet size ranges from 50–200 microns of mean diameter. An application of the present invention utilizes a water release device 32, which may be a water sprinkler head or a water mist device for generating a water mist or fog during operation.

Referring particularly to FIG. 1, a boost pump device 52 may be provided in fluid communication with water supply 50. Boost pump 52 may be operated via a controller 54 to provide water pressurization during a fire situation to facilitate the production and distribution of water through mist-style water release devices 32. In this regard, relatively small fluid conduits, such as ½ inch conduit, may be utilized to provide adequate water supply for water release devices. Boost pump 52 may be selected from among a variety of known fluid pump devices, including but not limited to diaphragm pumps, vane pumps, etc. Controller 54 may receive one or more signals via a communication line 56 from a switch (not shown) incorporated within a multiport fitting 14, or from a remote sensor 58 upon operation of a water release device 32 or other detection of a fire event. A variety of alternative boost pump 52, controller 54, communication line 56, and sensor 58 embodiments would be appreciated by those skilled in the relevants arts.

Figure 5:
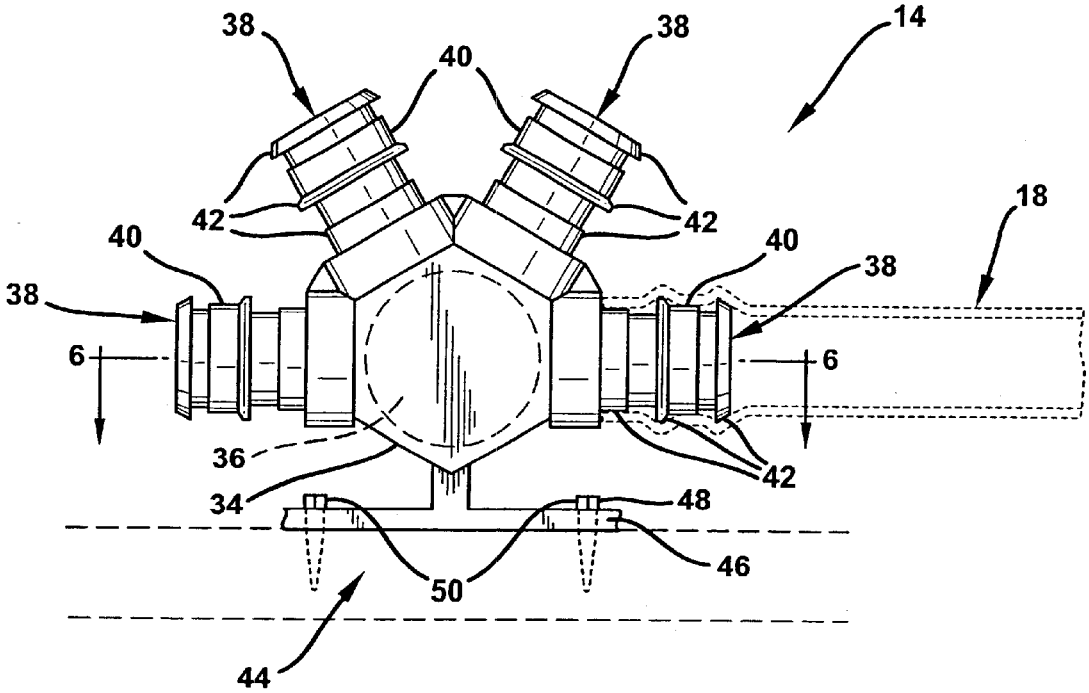
FIG. 5 is a top plan view of a multiport fitting according to the present invention.
Figure 6:
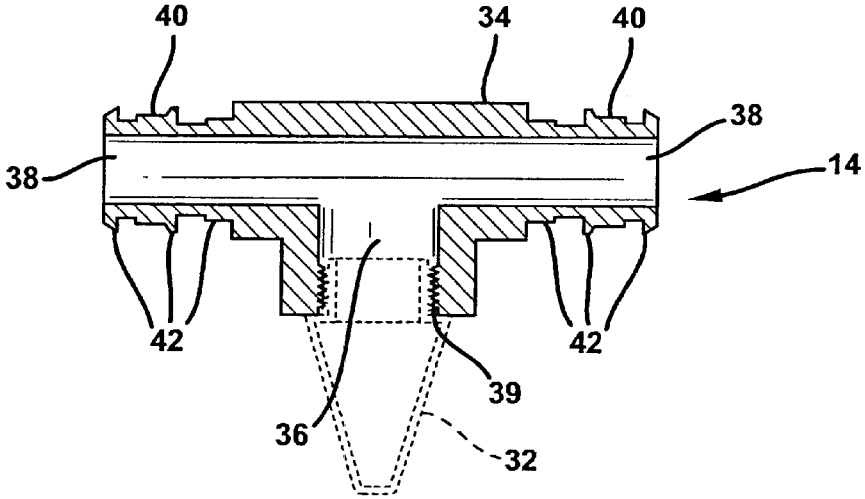
FIG. 6 is cross-sectional view of the multiport fitting of FIG. 5, taken along lines 6—6.

The construction of one embodiment of the multiport fitting 14 will be described with reference to FIGS. 5 and 6. Multiport sprinkler fitting 14 includes a body 34 having an interior cavity 36 and a plurality of through-bores or ports 38. The interior cavity 36 includes a threaded surface 39 for threadedly receiving and securing a water release device 32. In this manner, water release device 32 may be occasionally removed for maintenance or service. It is intended that a variety of different water release devices 32 may be used to implement the system 10 of the present invention. Selection of the specific water release device 32, such as a fire sprinkler or a water mist nozzle or head, will be apparent to one skilled in the art. Each multiport fitting 14 includes a plurality of ports 38, each port 38 having an external nipple portion 40. Nipple portions 40 are relatively smooth bored and include an external profile (ribbing) 42 for engaging the flexible conduit 16, 18 as will be described hereinafter. Each multiport fitting 14 is provided a support or hanging device 44 for attaching the multiport fitting 14 to a support member within the ceiling (or walls) of the structure 12 in which the system 10 is used. The support device 44 may include a flange 46 having apertures 48 through which fasteners 50 are used to secure the multiport fitting 14 to the structure 12. The multiport fitting 14 may include a hexagonal-shaped body 34 having a plurality of radiating nipple portions 40 which are offset to one side of the body 34. A flange 46 may be used to secure the multiport fitting 14 to a structural member (joist, wall, etc.) of the building 12 as illustrated in FIG. 5.

Referring again to FIG. 1, the integrated water distribution system 10 includes a plurality of interconnected multiport fittings 14. Each multiport fitting 14 is secured by an installer adjacent the ceiling with the support device 18. The multiport fittings 14 are interconnected through flexible conduits 16, 18 which may be cut to length at the site during the installation process and which are flexible so as to allow the conduits 16, 18 to be manipulated by the installer around obstacles, etc. The connection between the multiport fitting 14 and the conduits 16, 18 are press-type or "slip" connections, where the conduits 16, 18 are expanded by manually pressing the conduits 16, 18 onto the nipples 40 of the multiport fitting 14. This connection approach of the flexible conduits 16, 18 with the multiport fittings 14 is inherently more time efficient that many other mechanical connections, especially those of rigid pipings. A securement ring (not shown) may be utilized to secure the conduit 16, 18 to the nipple 40 of the multiport fitting 14.

The network 10 includes a plurality of feeder lines or water supply lines 16 which originate from a supply manifold 20, which is shown beneath the structure 12, though only for illustrative purposes. The manifold 20 in turn is connected to the house main 50 in conventional manner. The number of feeder lines 16 is determined through analysis of the water flow and pressure requirements of the system 10 as is appreciated by one skilled in the art. The feeder lines 16 are illustrated as being directly connected to the multiport fittings 14. However, the feeder lines 16 may alternatively be connected along the length of a conduit 18 (such as through a teefitting), if desired. A particularly novel aspect of the present invention is that a plurality of feeder lines 16, each connected to the manifold 20, are used to supply the network of multiport fittings 14. In this manner and as described below in operation, a "nonstagnant" water distribution system 10 is implemented. The plumbing fixtures of the systems are illustrated as a n water closet 22, a vanity sink 24, and a kitchen sink 26.

Figure 2:
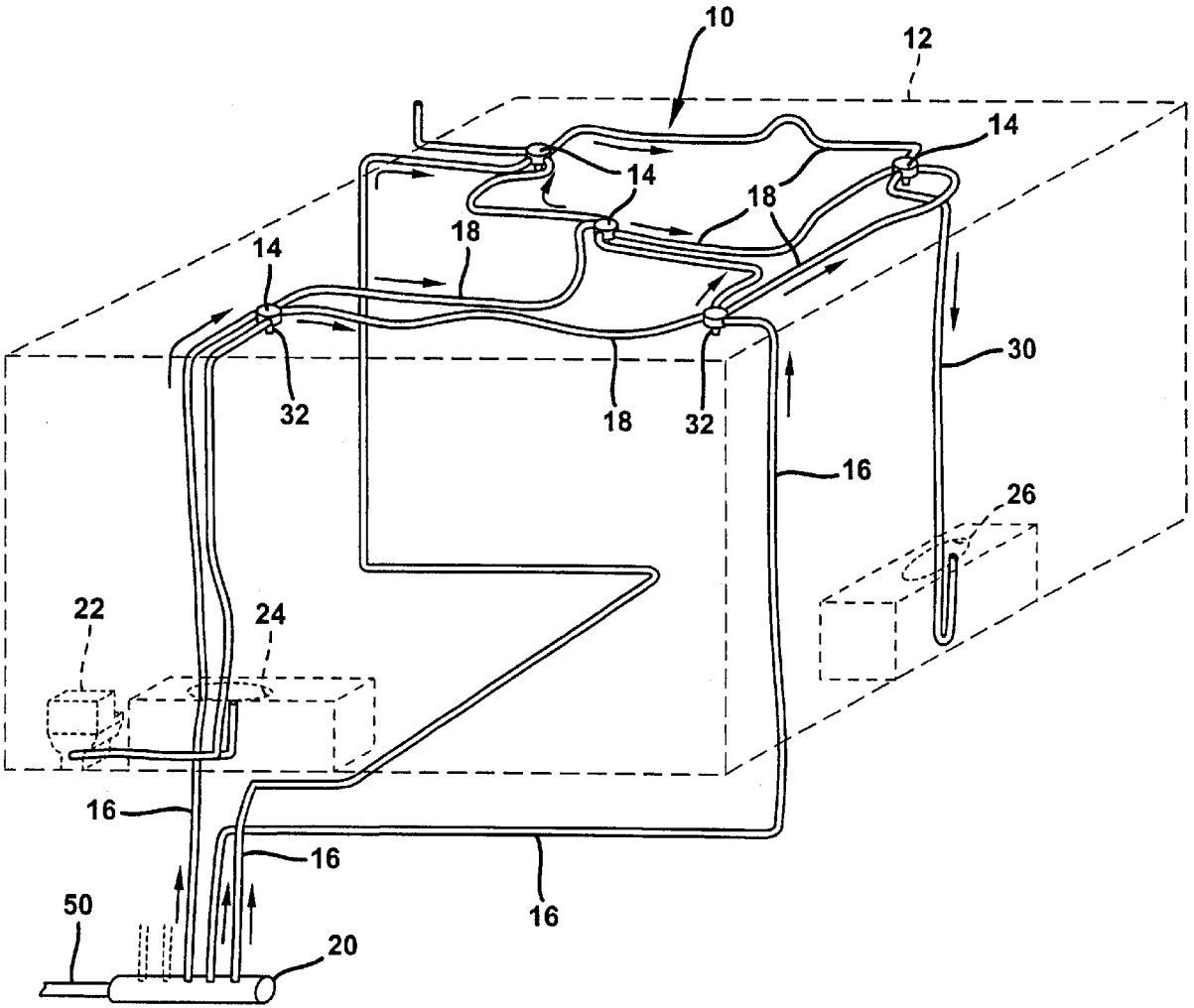
FIG. 2 is a perspective view of the water distribution network under a use condition.

Operation of the system 10 according to the present invention may now be described with reference to FIGS. 2–4, where a system 10 providing a distribution network for the domestic water needs and fire sprinkler requirements is illustrated. This system 10 provides a nonstagnant water distribution system for supplying requirements for both the domestic and fire sprinkler water fixture by establishing water flow within essentially the entire system 10 during occupant use of a plumbing fixture 22, 24, 26. Referring particularly to FIG. 2, the integrated water distribution network 10 illustrates the system flow during use of the kitchen sink 26. Water requirements for the sink 26 are providing by the entire network 10 through its associated multiport fitting 14 as illustrated by the flow arrows. In this manner, the water within the system 10 and between the multiport fittings 14 is in motion. While the flow rates of individual conduits 16, 18 may not be equal (and may be in directions other than as illustrated) there is some flow of water in the conduits 16, 18 between substantially all of the multiport fittings during sink 26 use. Furthermore, it is appreciated that water flows through each feeder conduit 16 from the manifold 20 during sink use (though the flow rates may not be equal). As a result, a nonstagnant flow system 10 is established.

Figure 3:
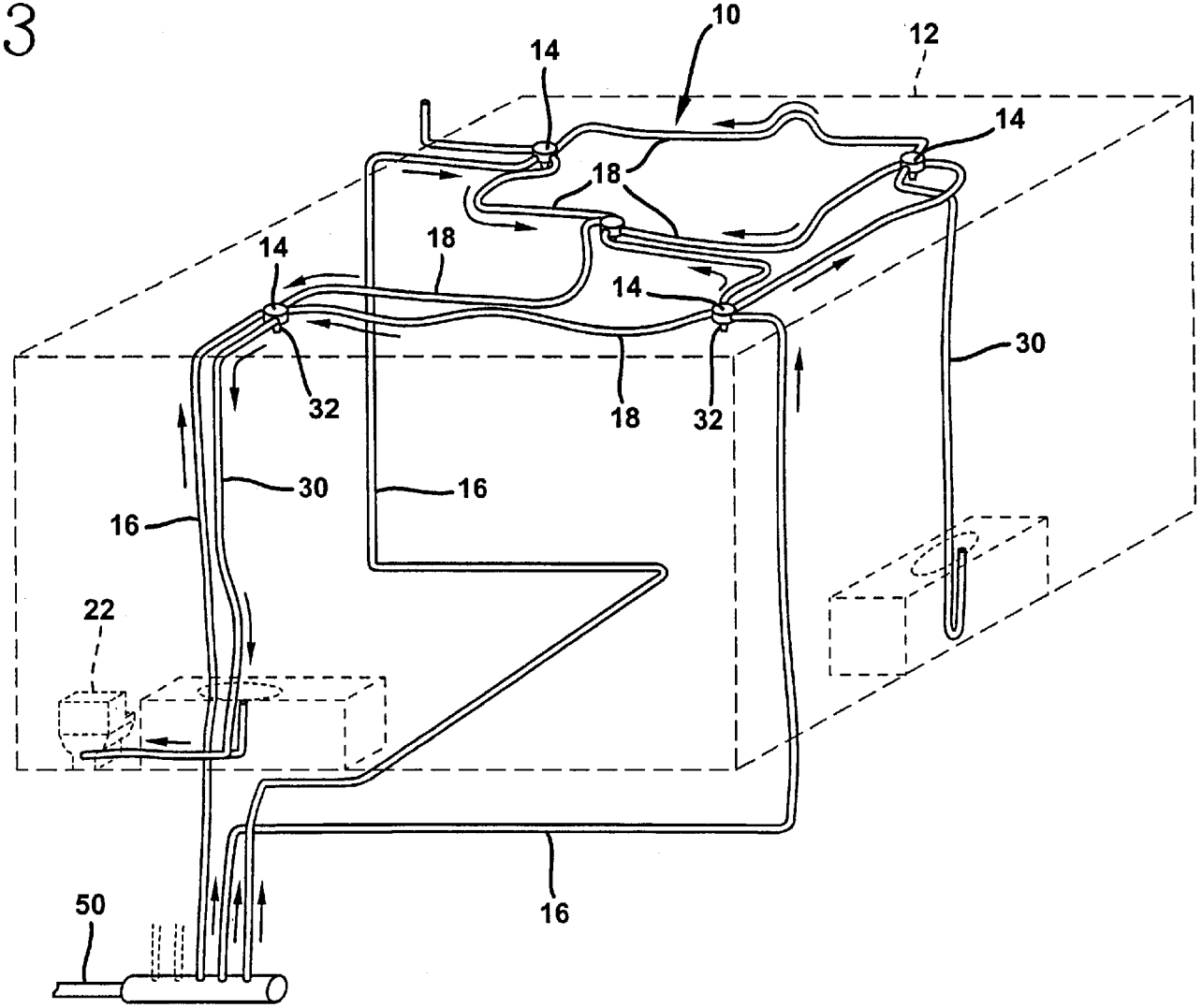
FIG. 3 is another perspective view of the water distribution network under a use condition.

Similarly, FIG. 3 illustrates the system 10 during occupant use of the water closet 22. The flow arrows again depict the direction of water flow within the conduits 18 between the multiport fitting 14 and in the supply lines 16. The exact flow rate and direction of flow within a particular conduit 16, 18 may be determined with additional information, if necessary. Importantly, FIG. 3 again illustrates that the water within the conduits 16, 18 is nonstagnant (in motion) during use of the water closet 22.

Figure 4:
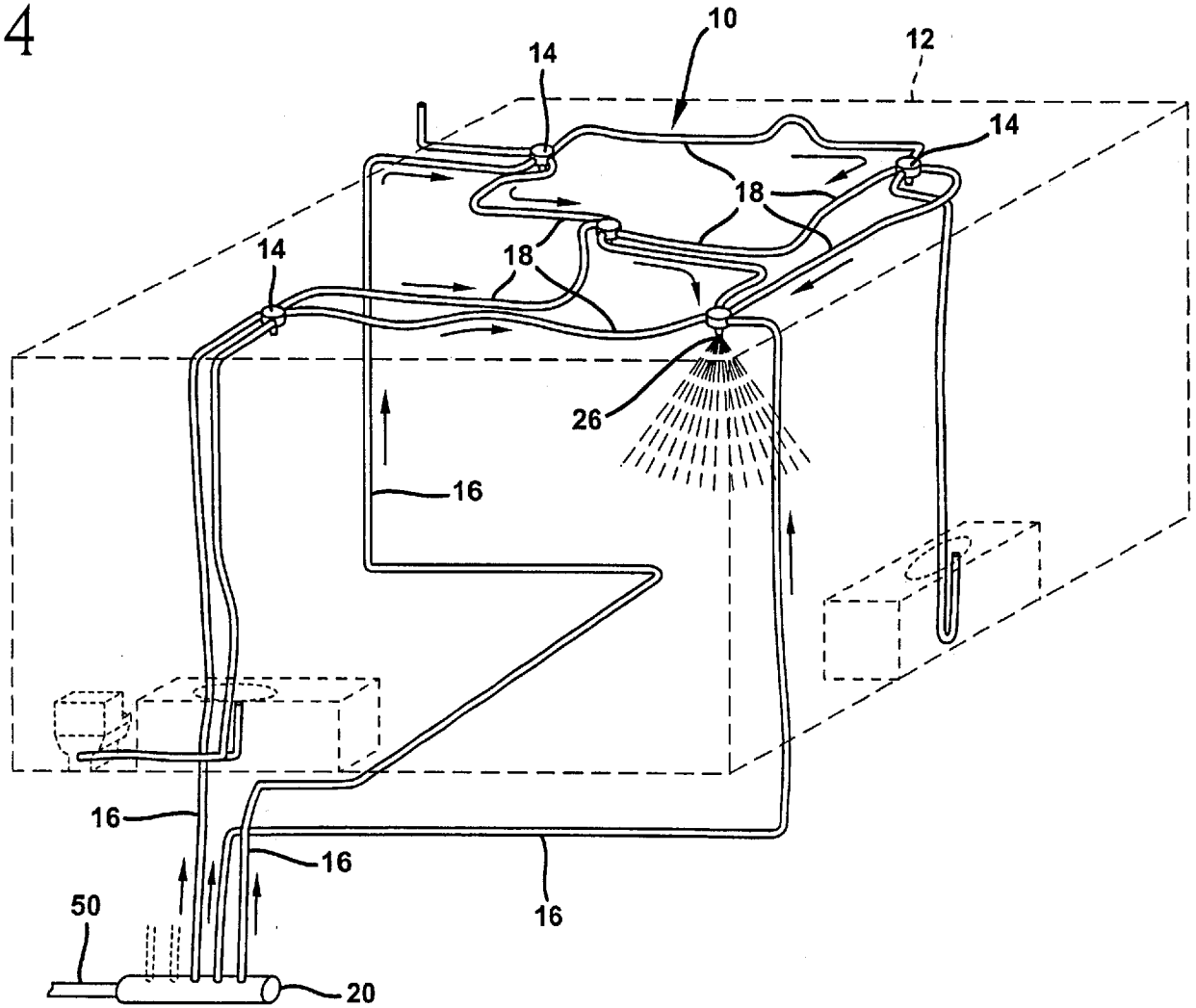
FIG. 4 is yet another perspective view of the water distribution network under a use condition.

FIG. 4 illustrates an additional benefit of invention according to the present invention. A water release device 32 is illustrated as having been activated. Water flow requirements for the water release device 32 are provided by the plurality of conduits 18 leading to the associated multiport fitting 14. In this manner, rather than a single large diameter conduit supplying water, a plurality of small diameter conduits 18 together supply the water release device 32. The water supply for the water release devices 32, which typically is plumbed using a single large diameter piping, is now provided by a plurality of smaller flexible conduits 16, 18.

An important benefit provided by the present invention is a "self-checking" fire sprinkler system 10 which allows the occupant to verify the fire sprinkler system 10 operability by simply using an of the variety of plumbing fixtures 22, 24, 26. In this regard, the occupant is ensured that pressurized water is available to the various fire sprinklers 32 if water is output from any plumbing fixture 22, 26, 28 upon occupant demand.

Figure 7:
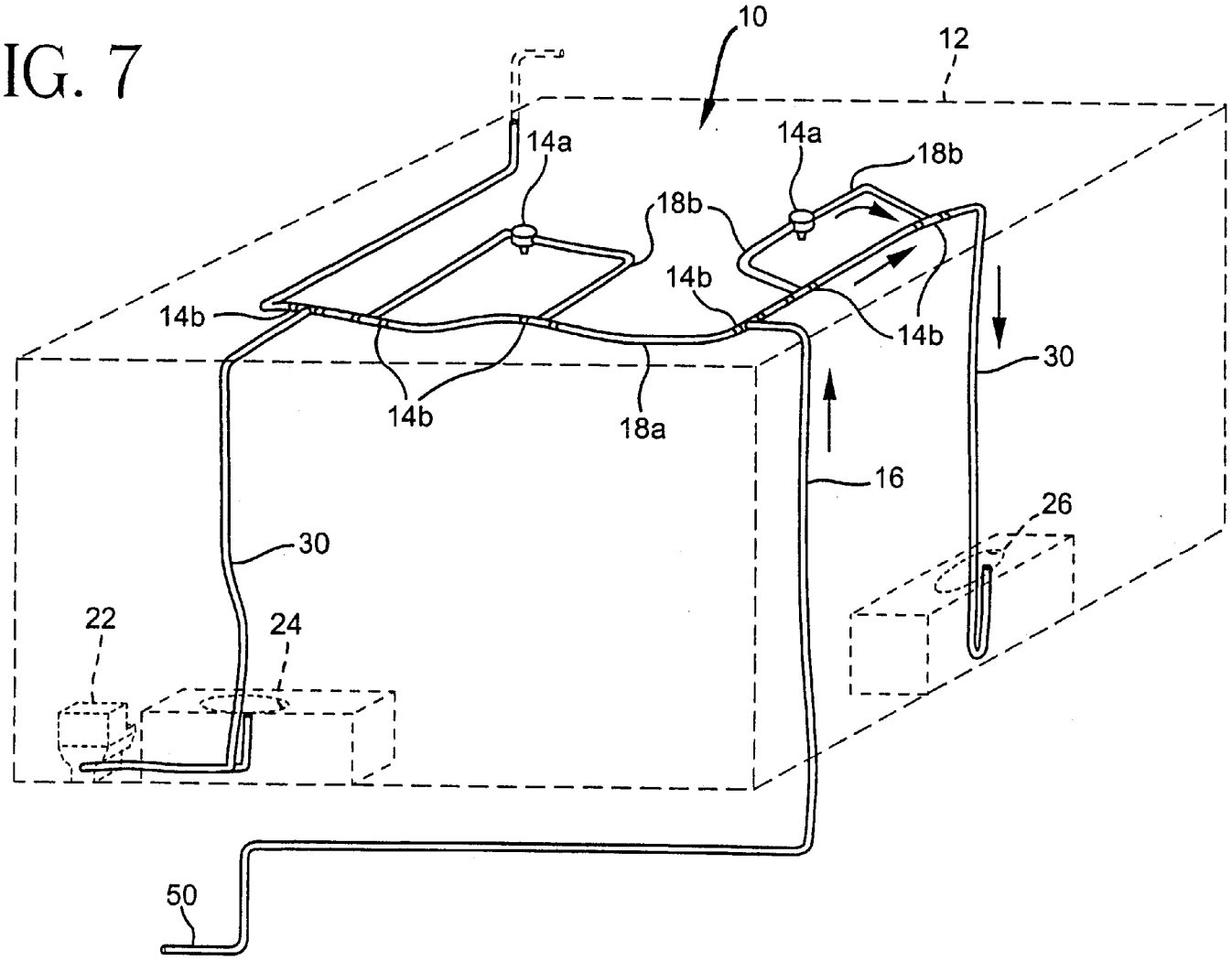
FIG. 7 is a perspective view of a second embodiment of an integrated water distribution network according to the present invention.

A second embodiment of an integrated water distribution system 10 for a building 12, such as a residential structure, is illustrated in FIG. 7. The system 10 includes a plurality of multiport fittings 14*a,b* interconnected with a plurality of water-carrying conduit 18. The system 10 further includes a main line 16 connected to the house main 50. The conduit 18*a,b* may include conduit having varying diameters depending on the flow situations and water requirements of the system. For instance, conduit 18*a* may have a 1" nominal diameter, and conduit 18*b* may have a ¾" nominal diameter.

Still referring to FIG. 7, the plumbing fixtures 22, 24, 26 are individually served by a routed conduit 30 and may include a watercloset 22, tub, vanity sink 24, or kitchen sink 26. Water release devices 32 are coupled to each multiport fitting 14a. Unlike the system of FIGS. 1–6, the multiport fitting 14*a* of FIG. 7 is defined as a two port fitting. In this embodiment, another multiport fitting 14*b*, such as a three-port "T" fitting, is used to fluidly couple the plurality of conduits 18*a*, and 18*b*. Additional plumbing connections or attachments such as valves, piping, expansion tanks, pipe fittings (elbows, tees, etc.) are all well know in the art of plumbing.

As illustrated in FIG. 7, upon an occupant use of the plumbing fixture 26, the integrated water distribution system of FIG. 7 will exhibit a non-stagnant flow throughout at least a portion of the water network, including at least one of the plurality of sprinkler head multiport fittings 14*a*.

Figure 8:
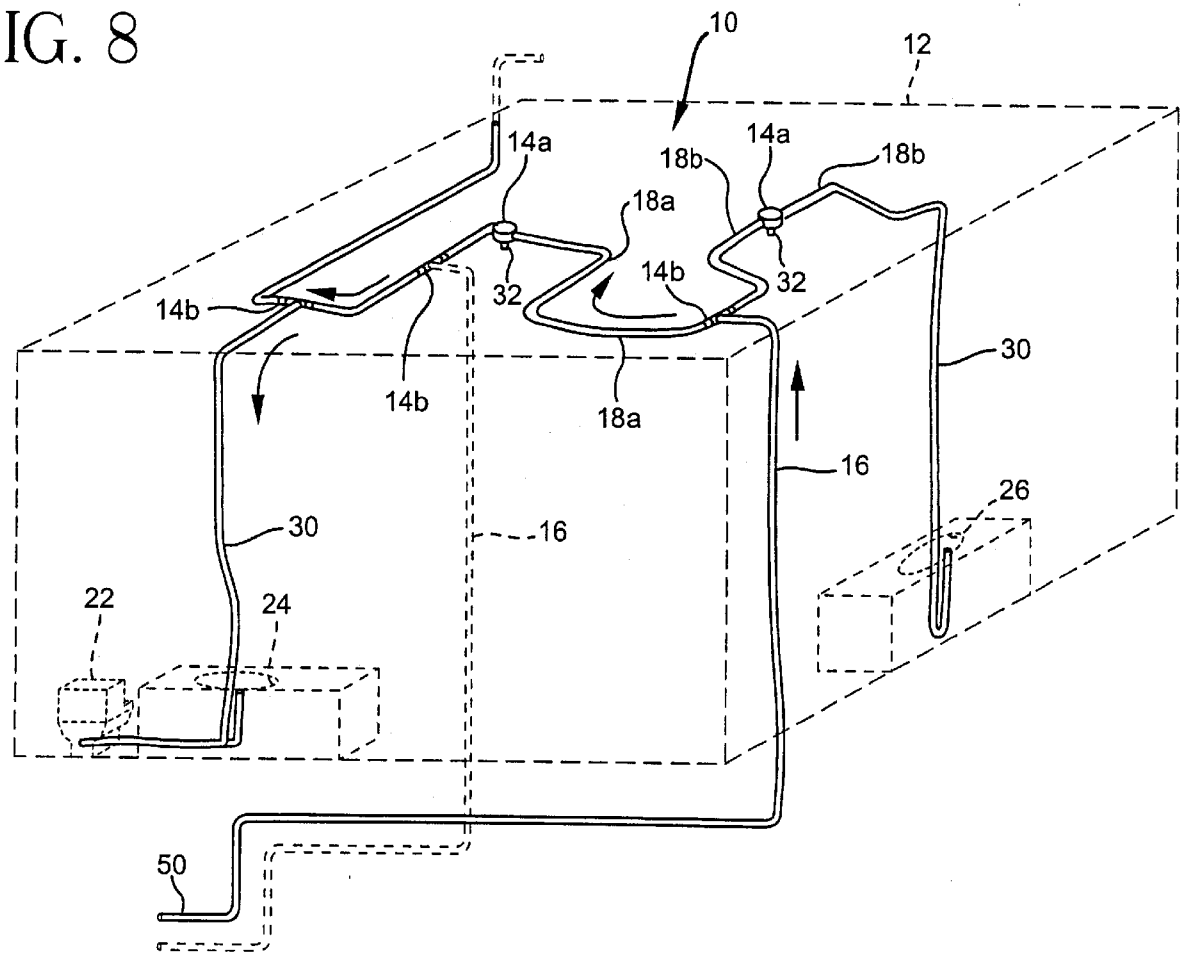
FIG. 8 is a perspective view of a third embodiment of an integrated water distribution network according to the present invention.

A third embodiment of an integrated water distribution system 10 for a building 12, such as a residential structure, is illustrated in FIG. 8. The system 10 includes a plurality of multiport fittings 14*a,b* interconnected with a plurality of water-carrying conduit 18. The system 10 further includes one or more water supply lines 16 connected to the house main 50, such as through a manifold assembly (not shown). The conduit 18 may include conduit having varying diameters depending on the flow situations and water requirements of the system. For instance, conduit 18*a* may have a 1" nominal diameter, and conduit 18*b* may have a ¾" nominal diameter.

Still referring to FIG. 8, the plumbing fixtures 22, 24, 26 are individually served by a routed conduit 30 and may include a watercloset 22, tub, vanity sink 24, or kitchen sink 26. water release devices 32 are coupled to each multiport fitting 14*a*. Unlike the system of FIGS. 1–6, the multiport fitting 14*a* of FIG. 8 is defined as a two port fitting. In this embodiment, another multiport fitting 14*b*, such as a three-port "T" fitting, is used to fluidly couple the plurality of conduits 18*a*, and 18*b*. Additional plumbing connections or attachments such as valves, piping, expansion tanks, pipe fittings (elbows, tees, etc.) are all well know in the art of plumbing.

As illustrated in FIG. 8, upon an occupant use of the plumbing fixture 24 the integrated water distribution system of FIG. 8 will exhibit a non-stagnant flow throughout at least a portion of the water network 10, including at least one of the plurality of multiport fittings 14*a*.

The present invention and many of its attendant advantages will be understood from the foregoing description and it will be apparent that various changes may be made in the form, construction and arrangement of the parts thereof including the network design without departing from the spirit and scope of the invention or sacrificing all of its material advantages, the form hereinbefore described being merely a preferred or exemplary embodiment thereof.

What is claimed is:

1. An integrated backflow diverter-less water distribution system for supplying both domestic water and fire protection system water requirements of a structure, said distribution system comprising:

a plurality of water-carrying conduits coupled together to establish a water loop, wherein each point along the water loop is in fluid communication with at least a pair of neighboring water-carrying conduits;

a plumbing fixture in fluid communication with the water loop at a predetermined point;

a water release device disposed upon the structure and being fluidly coupled to the water loop; and a water-supplying conduit fluidly coupled to said water loop for supplying the water loop with an amount of water relating to an occupant use of the plumbing fixture, wherein upon the occupant use the amount of water is supplied to the plumbing fixture through at least a pair of neighboring water-carrying conduits.

2. A water distribution system of claim 1 further comprising:

a plurality of multiport fittings, each of said plurality of multiport fittings having at least three ports, and each of the plurality of multiport fittings being fluidly coupled to a pair of water-carrying conduits.

3. A water distribution system of claim 2 wherein the water release device is fluidly coupled to the water loop through a port of the multiport fitting.

4. A water distribution system of claim 3 wherein the plumbing fixture is fluidly coupled to the water loop through a port of the multiport fitting.

5. A water distribution system of claim 1 wherein the plurality of water-carrying conduits are coupled together to establish a plurality of water loops within the structure.

6. A water distribution system of claim 1 wherein the water release device is a fire sprinkler.

7. A water distribution system of claim 1 wherein the water release device is a water mist head.

8. A water distribution system of claim 1 wherein the water-supplying conduit includes a plurality of water-supplying conduits each fluidly coupled at a different point to the water loop.

9. A water distribution system of claim 8 further comprising:

a water manifold for originating the plurality of water-supplying conduits.

10. A water distribution system of claim 1 wherein the plurality of water-carrying conduits includes a plurality of differently sized conduits.

11. A water distribution system of claim 1 further comprising a boost pump in fluid communication with the water-supplying conduit for supplying the water loop with pressurized water during a fire event.

12. A water distribution system of claim 11 wherein the boost pump is operatively controlled via an electronic controller.

13. An integrated backflow diverter-less water distribution system for supplying both domestic water and fire protection water requirements of a structure, said system comprising:

a plurality of water-carrying conduits intercoupled together to establish a water loop, wherein each point along the water loop is in fluid communication with at least a pair of neighboring water-carrying conduits;

a plumbing fixture fluidly coupled to the water loop;

a water release device fluidly coupled to the water loop at a predetermnined point; and a water-supplying conduit fluidly coupled to said water loop for supplying the water loop with an amount of water relating to a use of the water release device in a fire condition, wherein in the fire condition the amount of water is supplied to the water release device through at least a pair of neighboring water-carrying conduits.

14. A water distribution system of claim 13 further comprising:

a plurality of multiport fittings, each of said plurality of multiport fittings having at least three ports, and each of the plurality of multiport fittings being fluidly coupled to a pair of water-carrying conduits.

15. A water distribution system of claim 14 wherein the water release device is fluidly coupled to the water loop through a port of the multiport fitting.

16. A water distribution system of claim 13 wherein the plurality of water-carrying conduits are coupled together to establish a plurality of water loops within the structure.

17. A water distribution system of claim 13 wherein the water release device is a fire sprinkler head.

18. A water distribution system of claim 13 wherein the water release device is a water mist nozzle.

19. A water distribution system of claim 13 wherein the water-supplying conduit includes a plurality of water-carrying conduits each fluidly coupled at a different point to the water loop.

20. A water distribution system of claim 19 further comprising:

a water manifold for originating the plurality of water-supplying conduits.

21. A water distribution device according to claim 19, wherein the water release device is a water mist emitting device.

22. A water distribution system of claim 13 further comprising a boost pump in fluid communication with the water-supplying conduit for supplying the water loop with pressurized water during a fire event.

23. An integrated water distribution system for supplying both domestic water and fire protection water requirements of a structure, said system comprising:

a water supply conduit for providing the system with water;

a plurality of water-carrying conduits coupled together in fluid communication with the water supply conduit, said water-carrying conduits defining a first water path and a second water path away from the water supply conduit;

a water release device in fluid communication with the water supply conduit; and a plumbing fixture in fluid communication with the water supply conduit through both the first and second water paths, said plumbing fixture requiring an amount of water during a use thereof, and wherein upon the use of the plumbing fixture, a water flow is established in both of the first and second water paths.

24. A water distribution system of claim 23, further comprising a boost pump in fluid communication with the water-supplying conduit for supplying pressurized water to the water release device during a fire event.

* * * * *

UNITED STATES PATENT AND TRADEMARK OFFICE

CERTIFICATE OF CORRECTION

PATENT NO. : 6,422,319 B2
DATED : July 23, 2002
INVENTOR(S) : Franz P. Haase, III It is certified that error appears in the above-identified patent and that said Letters Patent is hereby corrected as shown below:

Column 9,
Line 10, delete “device” and insert -- system --; and
Line 10, delete “19” and insert -- 23 --.

Signed and Sealed this

Twenty-sixth Day of November, 2002

*Attest:*

*Attesting Officer*

JAMES E. ROGAN
*Director of the United States Patent and Trademark Office*